US005605313A

United States Patent [19]

Erickson et al.

[11] Patent Number: 5,605,313

[45] Date of Patent: Feb. 25, 1997

[54] VERTICAL SURFACE OBJECT HANGER

[76] Inventors: Donald L. Erickson; Linda L. Serna-Erickson, both of 9899 Sturgeon Ave., Fountain Valley, Calif. 92708

[21] Appl. No.: 503,282

[22] Filed: Jul. 17, 1995

[51] Int. Cl.[6] ..... A47G 1/16

[52] U.S. Cl. ..... 248/467; 248/477; 248/496; 248/497

[58] Field of Search ..... 248/467, 477, 248/496, 497, 549, 909

[56] References Cited

U.S. PATENT DOCUMENTS

| | | | |
|---|---|---|---|
| 1,496,282 | 6/1924 | Taylor | 248/467 |
| 3,529,799 | 9/1970 | Schaefer | 248/496 |
| 3,848,843 | 11/1974 | Levy | 248/496 X |
| 3,928,894 | 12/1975 | Bury et al. | 248/467 |
| 4,083,525 | 4/1978 | Rath | 248/477 X |
| 4,262,874 | 4/1981 | Seigh | 248/467 |
| 4,458,872 | 7/1984 | Couch | 248/497 |
| 4,611,780 | 9/1986 | Robertson | 248/477 |
| 4,775,129 | 10/1988 | Gleisten | 248/496 X |
| 4,950,065 | 8/1990 | Wyman | 248/467 X |
| 5,398,906 | 3/1995 | Aydelott | 248/477 X |

*Primary Examiner*—Leslie A. Braun
*Assistant Examiner*—Richard M. Smith

[57] ABSTRACT

A hanger for suspending an object from a vertical surface. The inventive device includes an object mounting assembly for securing to a rear surface of an object. A vertical surface mounting assembly is provided for mounting to a vertical surface such as a wall or a pane of glass. The vertical surface mounting assembly includes a mounting projection received within a central receiver of the object mounting assembly so as to adjustably and removably couple the object to the vertical surface.

6 Claims, 4 Drawing Sheets

VERTICAL SURFACE OBJECT HANGER

BACKGROUND OF THE INVENTION

1. Field of the Invention

The present invention relates to hanging devices and more particularly pertains to a vertical surface object hanger for suspending an object from a vertical surface.

2. Description of the Prior Art

The use of hanging devices is known in the prior art. More specifically, hanging devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art hanging devices include U.S. Pat. Nos 4,262,874; 4,542,876; 4,542,875; 4,106,742; 3,797,799; 5,314,159; and U.S. Pat. No. Des. 259,765.

While these devices fulfill their respective, particular objectives and requirements, the aforementioned patents do not disclose a vertical surface object hanger for suspending an object from a vertical surface which includes an object mounting means for securing to a rear surface of an object, and a vertical surface mounting means for mounting to a vertical surface, wherein the vertical surface mounting means includes a mounting projection received within a central receiver of the object mounting means so as to adjustably and removable couple the object to the vertical surface.

In these respects, the vertical surface object hanger according to the present invention substantially departs from the conventional concepts and designs of the prior art, and in so doing provides an apparatus primarily developed for the purpose of suspending an object from a vertical surface.

SUMMARY OF THE INVENTION

In view of the foregoing disadvantages inherent in the known types of hanging devices now present in the prior art, the present invention provides a new vertical surface object hanger construction wherein the same can be utilized for suspending an object from a vertical surface. As such, the general purpose of the present invention, which will be described subsequently in greater detail, is to provide a new vertical surface object hanger apparatus and method which has many of the advantages of the hanging devices mentioned heretofore and many novel features that result in a vertical surface object hanger which is not anticipated, rendered obvious, suggested, or even implied by any of the prior art hanging devices, either alone or in any combination thereof.

To attain this, the present invention generally comprises a hanger for suspending an object from a vertical surface. The inventive device includes an object mounting assembly for securing to a rear surface of an object. A vertical surface mounting assembly is provided for mounting to a vertical surface such as a wall or a pane of glass. The vertical surface mounting assembly includes a mounting projection received within a central receiver of the object mounting assembly so as to adjustably and removably couple the object to the vertical surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carded out in various ways. Also, it is to be understood that the phraseology and terminology employed herein are for the purpose of description and should not be regarded as limiting.

As such, those skilled in the an will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new vertical surface object hanger apparatus and method which has many of the advantages of the hanging devices mentioned heretofore and many novel features that result in a vertical surface object hanger which is not anticipated, rendered obvious, suggested, or even implied by any of the prior art tool guides, either alone or in any combination thereof.

It is another object of the present invention to provide a new vertical surface object hanger which may be easily and efficiently manufactured and marketed.

It is a further object of the present invention to provide a new vertical surface object hanger which is of a durable and reliable construction.

An even further object of the present invention is to provide a new vertical surface object hanger which is susceptible of a low cost of manufacture with regard to both materials and labor, and which accordingly is then susceptible of low prices of sale to the consuming public, thereby making such vertical surface object hangers economically available to the buying public.

Still yet another object of the present invention is to provide a new vertical surface object hanger which provides in the apparatuses and methods of the prior art some of the advantages thereof, while simultaneously overcoming some of the disadvantages normally associated therewith.

Still another object of the present invention is to provide a new vertical surface object hanger for suspending an object from a vertical surface.

Yet another object of the present invention is to provide a new vertical surface object hanger which includes an object mounting means for securing to a rear surface of an object, and a vertical surface mounting means for mounting to a vertical surface, wherein the vertical surface mounting means includes a mounting projection received within a central receiver of the object mounting means so as to adjustably and removable couple the object to the vertical surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
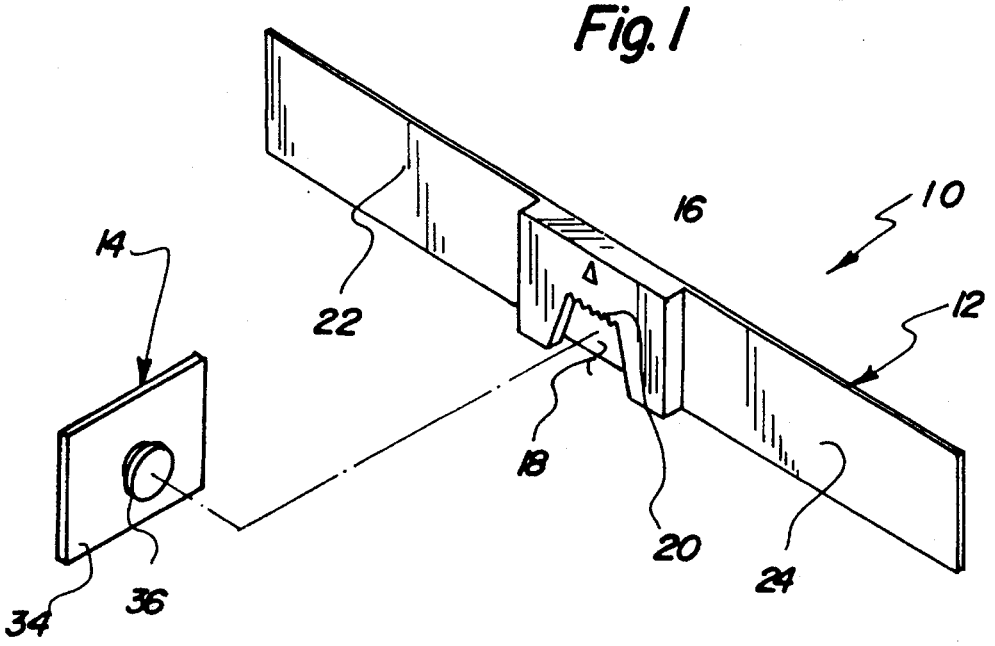
FIG. 1 is an exploded isometric illustration of a vertical surface object hanger according to the present invention.

With reference now to the drawings, and in particular to FIGS. 1–9 thereof, a new vertical surface object hanger embodying the principles and concepts of the present invention and generally designated by the reference numeral 10 will be described.

More specifically, it will be noted that the vertical surface object hanger 10 comprises an object mounting means 12 for securing to a rear surface of an object such as a plate or picture frame to be hung from a vertical surface. A vertical surface mounting means 14 is removably coupled to the object mounting means 12 for securing to a vertical surface such as a wall or a pane of glass so as to support an object coupled to the object mounting means 12 relative to the vertical surface. By this structure, an object such as a plate, picture frame, or other item of display can be suspended from a vertical surface such as a wall or a glass pane of a window.

Figure 2:
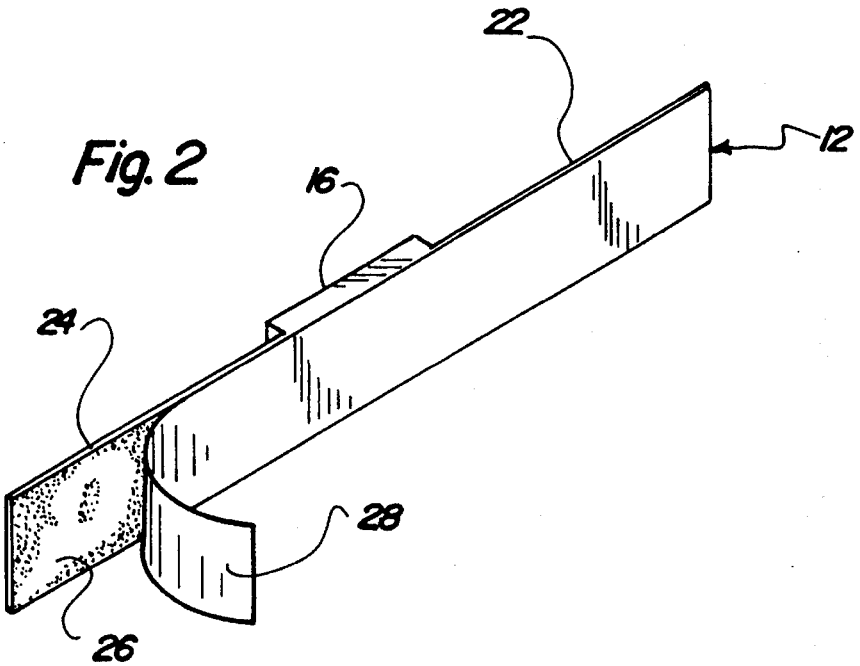
FIG. 2 is a rear isometric illustration of an object mounting means comprising a portion of the present invention.
Figure 3:
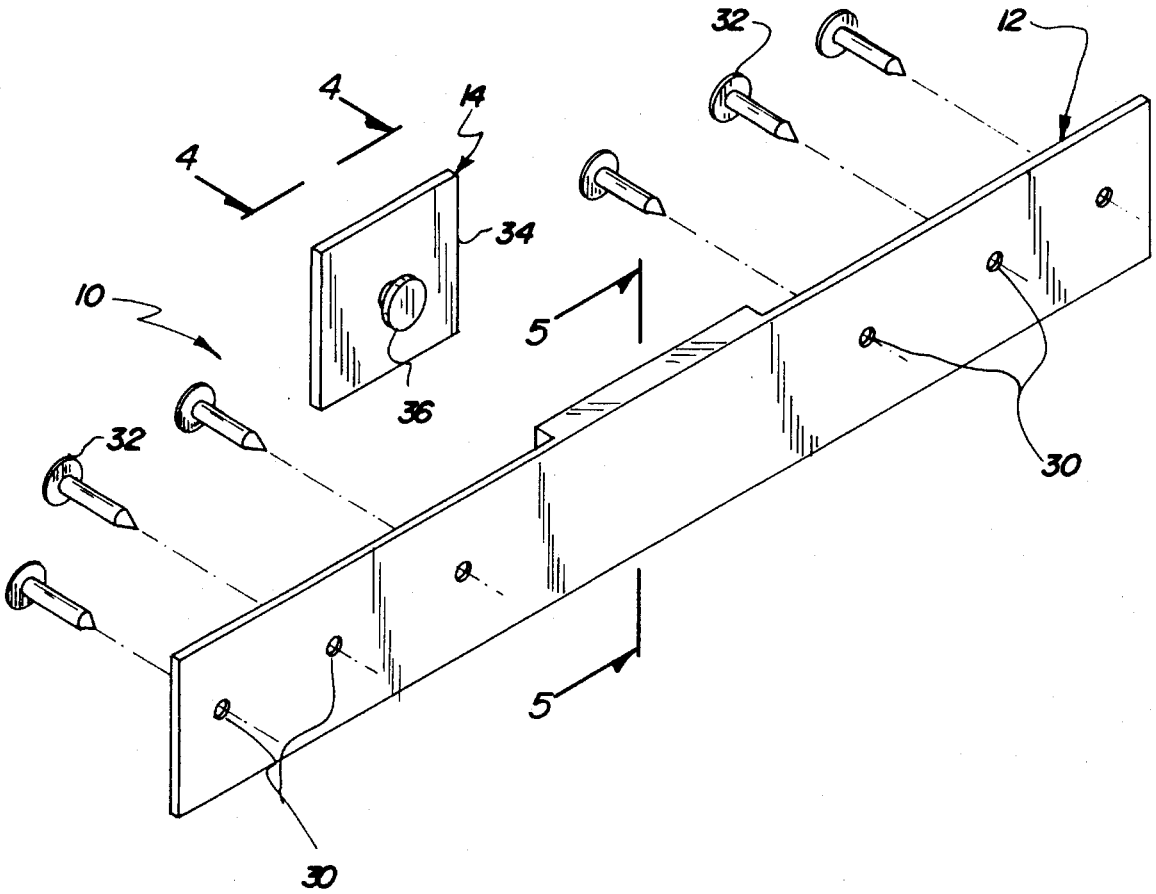
FIG. 3 is an exploded isometric illustration of the invention.

Referring initially to FIGS. 1 through 3 wherein the object mounting means 12 is illustrated in detail, it can be shown that the object mounting means of the present invention 10 preferably comprises a central receiver 16 shaped so as to define a receiving slot 18 directed thereinto and a serrated engaging edge 20 extending linearly across the receiving slot. A first lateral mounting plate 22 projects in a first direction from a lateral edge of the central receiver 16, with a second lateral mounting plate 24 projecting from a second lateral edge of the central receiver in a direction opposite that of the first lateral mounting plate 22. As shown in FIG. 2, the object mounting means 12 may include a pressure sensitive adhesive 26 applied to the engaging surfaces of the first and second lateral mounting plates 22 and 24 which is initially covered by a removable backing 28. The removable backing 28 can thus be separated from the pressure sensitive adhesive 26 so as to facilitate adhesive coupling of the object mounting means 12 to an associated object. Additionally or alternatively, the object mounting means 12 may include a plurality of mounting apertures 30 directed through the lateral mounting plates 22 and 24 which permit the projection of mounting fasteners 32 therethrough for securement of the object mounting means 12 to a picture frame or like object. The fasteners 32 may comprise tacks, nails, or threadably advancable fasteners as desired by an end user. By this structure, the object mounting means 12 can be adhesively and/or mechanically coupled to an associated object to be hung from a vertical surface.

Figure 4:
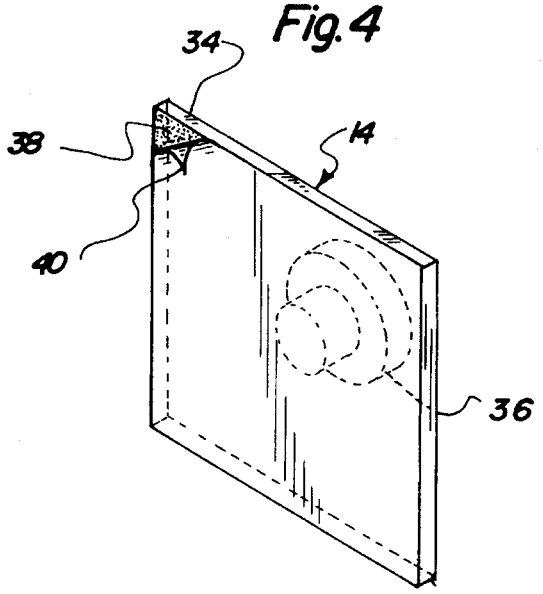
FIG. 4 is a rear isometric illustration of a vertical surface mounting means comprising a further portion of the present invention.
Figure 5:
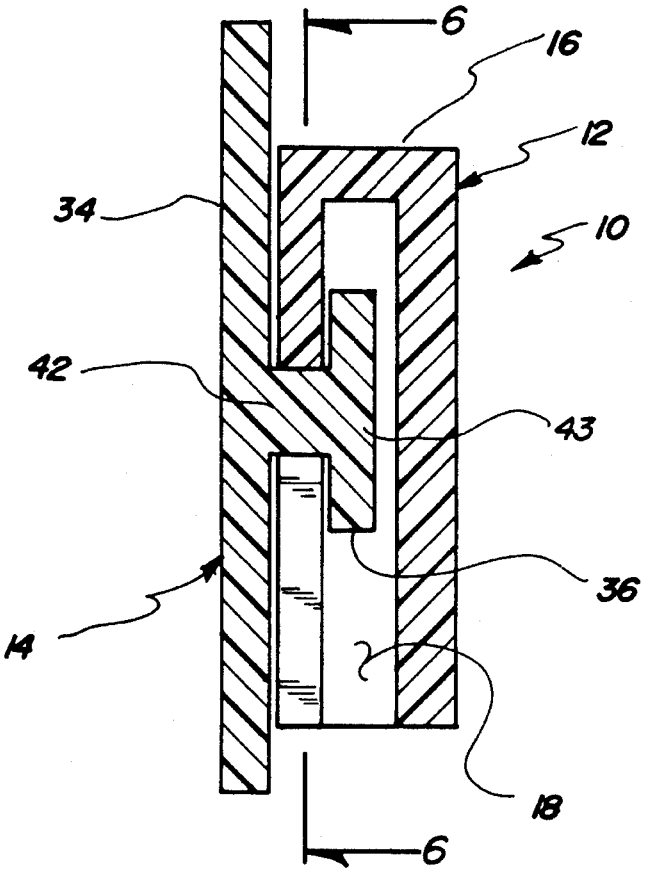
FIG. 5 is a cross-sectional view taken along line 5—5 of FIG. 3 with the vertical surface mounting means shown engaged with the object mounting means.
Figure 6:
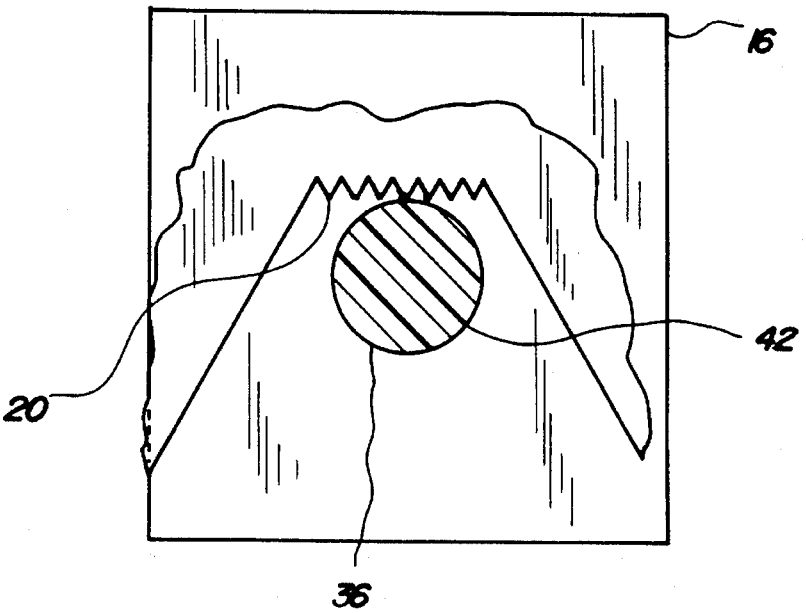
FIG. 6 is a cross-sectional view taken along line 6—6 of FIG. 5 illustrating a projecting member of the invention.

Referring now to FIGS. 4 through 6 with concurrent reference to FIG. 1, it can be shown that the vertical surface mounting means 14 of the present invention 10 preferably comprises a vertical surface mounting plate 34 having a mounting projection 36 extending substantially orthogonally therefrom. A pressure sensitive adhesive 38 is applied to an engaging surface of the mounting plate 34 and is covered by a removable backing 40 which can be selectively removed to expose the pressure sensitive adhesive 38 for adhesive coupling with a vertical surface such as a wall or a glass pane. The mounting projection 36 can thus be positioned within the receiving slot 18 so as to engage the serrated engaging edge 20, whereby the object will thus be suspended from the vertical surface to which the vertical surface mounting means 14 is secured.

Referring now to FIGS. 6 through 9, it can be shown that the mounting projection 36 comprises a projecting member 42 which is integrally or otherwise fixedly secured to the vertical surface mounting plate 34 and projects substantially orthogonally therefrom. The projecting member 42 terminates in a free distal end whereat an enlarged head 43 is integrally or otherwise secured thereto. As shown in FIG. 6, the projecting member 42 may comprise a cylindrical member having a smooth outer surface which simply engages the serrated engaging edge 20 of the central receiver 16 when positioned therein.

Figure 7:
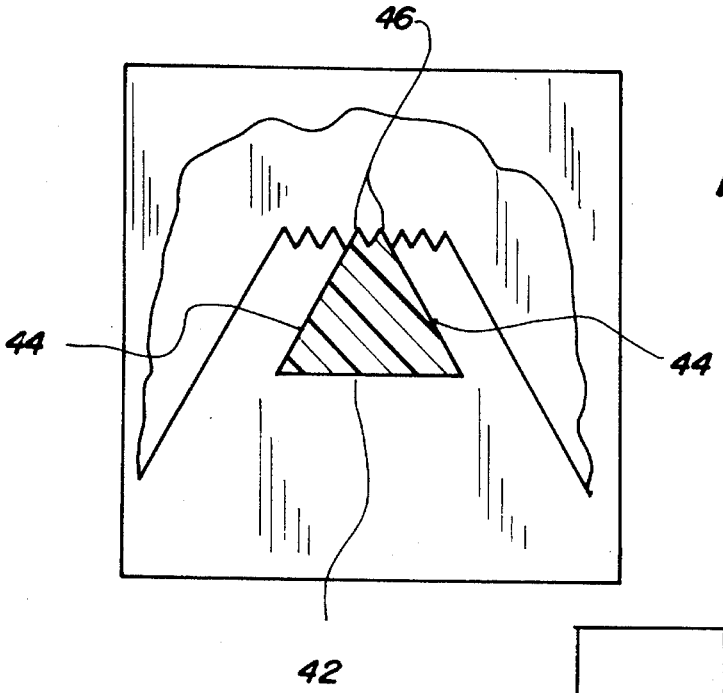
FIG. 7 is a cross-sectional view of an alternative form of the projecting member.

Alternatively, and as shown in FIG. 7, the projecting member 42 may be shaped so as to define a pair of angled lateral walls 44 tapering towards one another and terminating in a pair of projecting apex teeth 46 which cooperatively engage with serrations of the serrated engaging edge 20 so as to preclude lateral movements of the vertical surface mounting means 14 relative to the object mounting means 12. The pair of projecting apex teeth 46 are preferably oriented so as to extend in a linear row such that the vertical surface mounting means 14 is caused to angularly align with the object mounting means 12 when engaged thereto.

Figure 8:
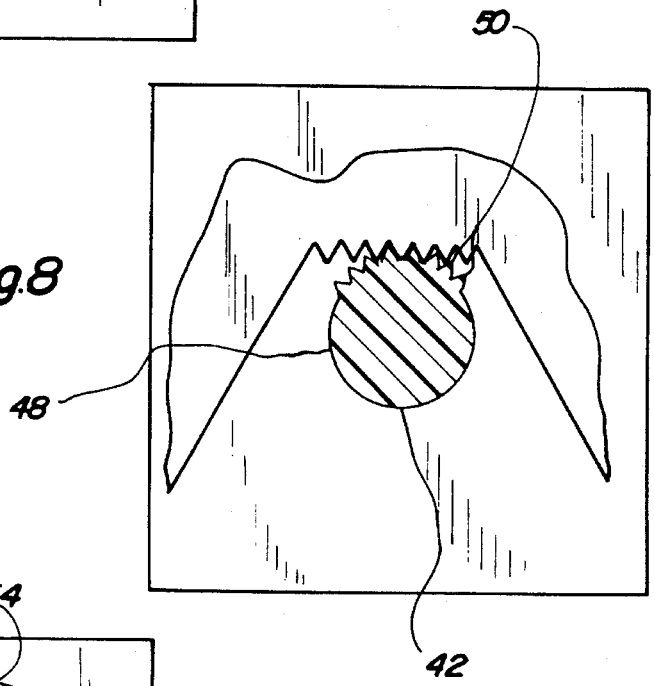
FIG. 8 is a cross-sectional view of illustrating yet alternative form of the projecting member.

As shown in FIG. 8, the projecting member 42 may alternatively comprise a cylinder having a cylindrical outer wall 48 including a plurality of cylinder teeth 50 formed thereon. The plurality of cylinder teeth 50 are preferably arranged in an arcuate array and cooperate with the serrations of the serrated engaging edge 20 so as to preclude lateral movement of the vertical surface mounting means 14 relative to the object mounting means 12. The plurality of cylinder teeth 50, in contrast to the pair of projecting apex teeth 46, permit an angular adjustment of the vertical surface mounting means 14 relative to the object mounting means 12 as desired so as to permit adjustment of an associated object relative to an associated vertical surface.

Figure 9:
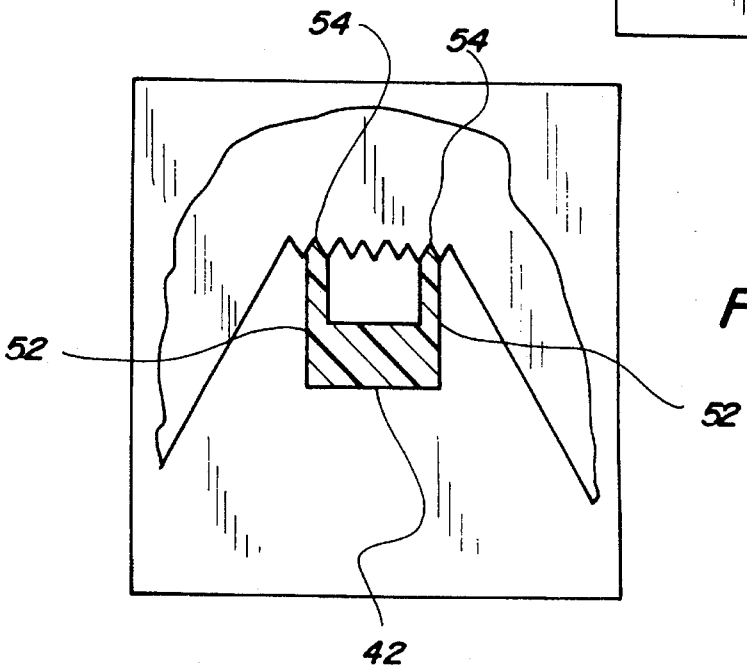
FIG. 9 is a cross-section view illustrating yet another alternative form of the projecting member.

Referring now to FIG. 9, it can be shown that the projecting member 42 may further alternatively comprise a pair of vertical support plates 52 projecting in a substantially spaced and parallel orientation relative to one another from the projecting member 42. Each of the vertical support plates 52 terminates in an engaging tooth 54 which can be cooperatively engaged with serrations of the serrated engaging edge 20 of the central receiver 16. Preferably, the engaging teeth 54 are initially oriented so as to extend in a linear row so as to support the vertical surface mounting means 14 in a desired angular orientation relative to the object mounting means 12. Further, the vertical support plates 52 are preferably formed of a material which can be cut or trimmed to a desired height so as to permit adjustment of such angular orientation between the vertical surface mounting means 14 and the object mounting means 12. By this structure, an individual hanging an object through a use of the device 10 can selectively adjust an angular orientation of the object mounting means 12 relative to the vertical surface mounting means 14 through a cutting of the engaging teeth 54 of the vertical support plates 52 to effect angular adjustment of the object relative to the vertical surface as desired, whereby such adjustment will then be retained by the linear orientation of the engaging teeth 54.

In use, the vertical surface object hanger 10 according to the present invention can be easily utilized to effect suspension or hanging of an object relative to a vertical surface. The various forms of the mounting projection 36 can be utilized to permit or preclude various lateral or angular adjustments between the object mounting means 12 and the vertical surface mounting means 14 as desired by an end user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A vertical surface object hanger comprising;

an object mounting means for securing to a rear surface of an object, the object mounting means comprises a central receiver shaped so as to define a receiving slot directed thereinto and serrated engaging edge extending linearly across the receiving slot; a first lateral mounting plate projecting in a first direction from a lateral edge of the central receiver; and a second lateral mounting plate projecting from a second lateral edge of the central receiver in a direction opposite that of the first lateral mounting plate;

a vertical surface mounting means removably coupled to the object mounting means for securing to a vertical surface so as to support an object coupled to the object mounting means relative to the vertical surface, the vertical surface mounting means comprises a vertical surface mounting plate having a mounting projection extending substantially orthogonally therefrom, the mounting projection being positioned within the receiving slot of the object mounting means so as to engage the serrated engaging edge, whereby the object mounting means will be suspended from the vertical surface mounting means; and the mounting projection comprises a projecting member secured to the vertical surface mounting plate and projecting substantially orthogonally therefrom, the projecting member being shaped so as to define a pair of angled lateral walls tapering towards one another and terminating in a pair of projecting apex teeth which cooperatively engage with serrations of the serrated engaging edge so as to preclude lateral movements of the vertical surface mounting means relative to the object mounting means.

2. The vertical surface object hanger of claim 1, wherein the pair of projecting apex teeth are oriented so as to extend in a linear row such that the vertical surface mounting means is caused to angularly align with the object mounting means.

3. The vertical surface object hanger of claim 1, wherein the projecting member comprises a cylinder having a cylindrical outer wall including a plurality of cylinder teeth formed thereon, the plurality of cylinder teeth being arranged in an arcuate array and cooperating with the serrations of the serrated engaging edge so as to preclude lateral movement of the vertical surface mounting means relative to the object mounting means, while permitting angular adjustment of the vertical surface mounting means relative to the object mounting means.

4. The vertical surface object hanger of claim 1, wherein the projecting member comprises a pair of vertical support plates projecting in a substantially spaced and parallel orientation relative to one another from the projecting member, each of the vertical support plates terminating in an engaging tooth cooperatively engaged with serrations of the serrated engaging edge of the central receiver.

5. The vertical surface object hanger of claim 4, wherein the engaging teeth are initially oriented so as to extend in a linear row to support the vertical surface mounting means in an angular orientation relative to the object mounting means.

6. The vertical surface object hanger of claim 5, wherein the vertical support plates are formed of a trimmable material which can be cut to a desired height so as to permit adjustment of the angular orientation between the vertical surface mounting means and the object mounting means.

* * * * *